US008026854B2

(12) United States Patent
Sanada

(10) Patent No.: US 8,026,854 B2
(45) Date of Patent: Sep. 27, 2011

(54) STRIPLINE-TYPE COMPOSITE RIGHT/LEFT-HANDED TRANSMISSION LINE OR LEFT-HANDED TRANSMISSION LINE, AND ANTENNA THAT USES SAME

(75) Inventor: Atsushi Sanada, Yamaguchi (JP)

(73) Assignee: Yamaguchi University, Yamaguchi-shi (JP)

( * ) Notice: Subject to any disclaimer, the term of this patent is extended or adjusted under 35 U.S.C. 154(b) by 352 days.

(21) Appl. No.: 12/373,866

(22) PCT Filed: Jun. 27, 2007

(86) PCT No.: PCT/JP2007/062853

§ 371 (c)(1),
(2), (4) Date: Jan. 14, 2009

(87) PCT Pub. No.: WO2008/007545

PCT Pub. Date: Jan. 17, 2008

(65) Prior Publication Data

US 2009/0174609 A1 Jul. 9, 2009

(30) Foreign Application Priority Data

Jul. 14, 2006 (JP) ..... 2006-194046

(51) Int. Cl.
*H01Q 1/38* (2006.01)

(52) U.S. Cl. ..... 343/700 MS; 343/846

(58) Field of Classification Search ..... 343/700 MS, 343/846; 333/238
See application file for complete search history.

(56) References Cited

U.S. PATENT DOCUMENTS 6,593,833 B2 * 7/2003 Joines et al. ..... 333/238
7,411,774 B2 * 8/2008 Leeper, II ..... 361/277

FOREIGN PATENT DOCUMENTS

JP 02-186703 A 7/1990
JP 2004-104382 A 4/2004
JP 2007-81825 A 3/2007

OTHER PUBLICATIONS

S. Matsuzawa et al., "Ekisho o Mochiita Millimeter Wave Band Hidaritekei Moreha Antenna", Nen IEICE Communications Society Conference Koen Ronbunshu, Sep. 2005, pp. 179-182.
International Search Report of PCT/JP2007/062853, Mailing Date of Jul. 24, 2007.

* cited by examiner

*Primary Examiner* — Hoang V Nguyen
(74) *Attorney, Agent, or Firm* — Westerman, Hattori, Daniels & Adrian, LLP

(57) ABSTRACT

The present invention provides a sripline-type transmission line which can easily change and control transmission characteristics by changing the permittivity of a substrate, and also provides an antenna that can extensively change and control the direction of radiation with the frequency of an electromagnetic wave constant, by using this transmission line.

13 Claims, 9 Drawing Sheets

STRIPLINE-TYPE COMPOSITE RIGHT/LEFT-HANDED TRANSMISSION LINE OR LEFT-HANDED TRANSMISSION LINE, AND ANTENNA THAT USES SAME

TECHNICAL FIELD

The present invention relates to a stripline-type composite right/left-handed transmission line or left-handed transmission line, which uses a material with variable permittivity typified by a liquid crystal or the like in the dielectric medium, and which is made up of a metamaterial, and to an antenna that uses the stripline-type composite right/left-handed transmission line or left-handed transmission line.

BACKGROUND

It is possible to artificially constitute a medium that has properties not found in nature by arranging small pieces (unit cells) of a metal, a dielectric, magnetic material and a superconductor at sufficiently shorter intervals than a wavelength (about 1/10 of the wavelength or less). A medium like this is called a metamaterial, in the sense that it is a medium that belongs to a category that is larger than the category of a medium found in the natural world. The properties of a metamaterial change in various ways depending on the shape and material properties of the unit cell, and the arrangement thereof.

Among these, a metamaterial that has an equivalent permittivity $\in$ and magnetic permeability $\mu$ and is simultaneously negative has been called a "left-handed medium (LHM: Left-Handed Materials)" because its electric field, magnetic field and wave vector form a left-handed system. In contrast to this, a normal medium that has an equivalent permittivity $\in$ and magnetic permeability $\mu$ and is simultaneously positive is called a "right-handed medium (RHM: Right-Handed Materials)". The relationship between the permittivity $\in$ and magnetic permeability $\mu$ and the type of medium is shown in FIG. 1. Mediums can be classified into a first quadrant to a fourth quadrant in accordance with a positive and negative permittivity $\in$ and a positive and negative magnetic permeability $\mu$. A right-handed medium is a first quadrant medium, and a left-handed medium is a third quadrant medium.

In particular, the left-handed medium has peculiar properties, such as the existence of a wave (called a backward-wave) having a wave group velocity (propagation velocity of energy) and a phase velocity (progression velocity of phase) with opposite signs, and an amplification of an evanescent wave, which exponentially decays in a nonpropagation region. Now then, it is possible to use a left-handed medium to artificially constitute a transmission line that transmits a backward-wave. This fact is disclosed in Non-Patent Document 1 and Non-Patent Document 2 cited hereinbelow.

Based on this concept of a left-handed medium constitution, a transmission line that propagates a backward-wave by periodically lining up unit cells comprising a metal pattern, is proposed. This transmission characteristic has been handled theoretically until now, and it has become theoretically evident that this transmission line has a left-handed transmission band, that a bandgap occurs between the left-handed transmission band and the right-handed transmission band, and that the bandgap width thereof can be controlled by the reactance among the unit cells. Further, a transmission line that is capable of simultaneously transmitting a left-handed transmission band and a right-handed transmission band is called a composite right/left-handed transmission line. These points are disclosed in Non-Patent Document 3 cited hereinbelow.

FIG. 2 is a diagram showing the constitution of a microstrip line commonly used in the past. FIG. 2(A) is an oblique view of the microstrip line, and FIG. 2(B) is a cross-sectional view showing an overview of the electromagnetic field of an electromagnetic wave propagated over the microstrip line. The microstrip line comprises a conductor 4 that serves as a transmission line disposed on the front surface of a substrate 1 of thickness d comprising a dielectric substance, and a ground conductor 3 disposed on the rear surface of the substrate 1. The electric field E and magnetic field H of the electromagnetic wave propagated over this microstrip line are as shown in FIG. 2(B). Since a half-space is opened on the one side of the transmission line (the top surface side) of the microstrip line, radiation toward the space occurs in the radiation region (region in which the phase constant of the propagation wave of the transmission line is smaller than the in-vacuum wave number).

A right/left-handed transmission line based on the constitution of the transmission line of this type of microstrip line has already been produced, and the transmission characteristics of this microstrip line-type right/left-handed transmission line have been verified experimentally. This is disclosed in Non-Patent Documents 2 and 3. The microstrip line-type right/left-handed transmission line is such that unit cells comprising conductors that are insulated from one another are periodically arrayed in the z direction as conductors 4 in FIG. 2(A).

Because the microstrip line-type right/left-handed transmission line has a property that radiates a portion of the transmission energy in a frequency region in which the phase constant of a wave is smaller than the in-vacuum wave number, it is confirmed that the right/left-handed transmission line can be used as an antenna by taking advantage of this property. This is disclosed in Non-Patent Documents 2 and 3.

In addition to the microstrip line, a stripline has also been used as a transmission line for some time now. FIG. 3 is a diagram showing the constitution of a stripline. FIG. 3(A) is an oblique view of the stripline, and FIG. 3(B) is a cross-sectional view showing an overview of the electromagnetic field of an electromagnetic wave propagated over the stripline. The stripline is such that ground conductors 2 and 3 are disposed on the front surface and rear surface of a substrate 1 of thickness s comprising a dielectric substance, and a conductor 4 is disposed as a transmission line in an intermediate plane of the substrate 1 (plane located at a thickness of s/2). The electrical field E and magnetic field H of the electromagnetic wave propagated over this stripline are as shown in FIG. 3(B). Radiation essentially does not occur because both the front surface and rear surface of the stripline are covered by ground conductors 2, 3.

The inventors have already proposed a composite right/left-handed transmission line and left-handed transmission line based on this stripline-type transmission line constitution. This is the transmission line shown in FIGS. 4(A) and (B). FIG. 4(A) is an oblique view displaying only the conductor that constitutes the transmission line, and FIG. 4(B) is a cross-sectional view of the transmission line. This transmission line is such that ground conductors 2 and 3 are disposed on the front surface and rear surface of a substrate 1 of thickness s comprising a dielectric substance, and a conductor pattern 4 is disposed as a transmission line in an intermediate plane of the substrate 1 (plane located at a thickness of s/2). The conductor pattern 4 is such that unit cells comprising conductors that are insulated from one another are arrayed periodically in the direction of transmission.

[Non-Patent Document 1] D. R. Smith, W. J. Padilla, D. C. Vier, S. C. Nemat-Nasser, and S. Schultz, "Composite medium with simultaneously negative permeability and permittivity", Phys. Rev. Lett., vol. 84, no. 18, pp. 4184-4187, May 2000

[Non-Patent Document 2] C. Caloz and T. Itoh, "Application of the transmission line theory of left-handed (LH) materials to the realization of a microstrip LH line", IEEE-APS Int'l Symp. Digest, vol. 2, pp. 412-415, June 2002

[Non-Patent Document 3] Atsushi Sanada, Christophe Caloz and Tatsuo Itoh, "Characteristics of the Composite Right/Left-Handed Transmission Lines", IEEE Microwave and Wireless Component Letters, Vol. 14, No. 2, pp. 68-70, February 2004

When a conventional microstrip line-type right/left handed transmission line is used as a leaky-wave antenna, the direction of a radiating electromagnetic wave can be changed by changing the frequency of the electromagnetic wave to be propagated. However, when the frequency variability range is small, the change in the direction of the radiating electromagnetic wave cannot be controlled across a broad range. Further, it is the same when a constitution for radiating an electromagnetic wave is added to a stripline-type right/left-handed transmission line, and this stripline-type right/left-handed transmission line is used as a leaky-wave antenna, and the change in the direction of the radiating electromagnetic wave cannot be controlled across a broad range when the frequency variability range is small.

DISCLOSURE OF THE INVENTION

Accordingly, an object of the present invention is to provide a stripline-type transmission line, which is capable of carrying out signal transmission without radiation even in a region in which the phase constant of the propagation wave is smaller than the in-vacuum wave number, and which does not suffer from transmission energy loss. Further, another object of the present invention is to provide a stripline-type left-handed transmission line and a stripline-type composite right/left-handed transmission line, which are capable of controlling the change in transmission characteristics across a broad range by controlling a change in the permittivity of the substrate without giving rise to a bandgap between the right-handed transmission band and the left-handed transmission band. In addition, another object of the present invention is to provide an antenna that uses a stripline-type transmission line, which is capable of using these stripline-type transmission lines, and of readily controlling a change in the direction of radiation even when the electromagnetic wave frequency is constant.

In order to achieve the objects mentioned above, a stripline-type composite right/left-handed transmission line of the present invention has a plate-shaped substrate comprising a dielectric medium, which is either partially or wholly composed of a material with variable permittivity; a plurality of conductor patterns, which are disposed in an intermediate plane of the above-mentioned substrate, and which are periodically arranged in a fixed direction; and ground conductors, which are disposed on the front surface and rear surface of the above-mentioned substrate. The above-mentioned conductor pattern is disposed by being galvanically isolated from another conductor pattern and the above-mentioned ground conductors. This stripline-type composite right/left-handed transmission line is capable of propagating an electromagnetic wave in a right-handed region and in a left-handed region.

Further, when the phase constant of the electromagnetic wave to be propagated is represented as $\beta$, the array periodicity dimensions of the above-mentioned conductor pattern is represented as a, and the circumference ratio is represented as $\pi$ in the above-mentioned stripline-type composite right/left-handed transmission line, and the value $\beta a/\pi$ falls within the range of $-1.0$ to 1.0, an electromagnetic wave can be propagated in the right-handed region and in the left-handed region.

Further, the stripline-type left-handed transmission line of the present invention has a plate-shaped substrate comprising a dielectric medium, which is either partially or wholly composed of a material with variable permittivity; a plurality of conductor patterns, which are disposed in an intermediate plane of the above-mentioned substrate, and which are periodically arranged in a fixed direction; and ground conductors, which are disposed on the front surface and rear surface of the above-mentioned substrate. The above-mentioned conductor pattern is disposed by being galvanically isolated from another conductor pattern and the above-mentioned ground conductors. This stripline-type left-handed transmission line is capable of propagating an electromagnetic wave in a left-handed region.

Further, in the above-mentioned stripline-type left-handed transmission line, when the phase constant of the electromagnetic wave to be propagated is represented as $\beta$, the array periodicity dimension of the above-mentioned conductor pattern is represented as a, and the circumference ratio is represented as $\pi$, and the value $\beta a/\pi$ falls within the range of $-1.0$ to 0, an electromagnetic wave can be propagated in the left-handed region.

Further, an antenna that uses a stripline-type transmission line of the present invention has a plate-shaped substrate comprising a dielectric medium, which is either partially or wholly composed of a material with variable permittivity; a plurality of conductor patterns, which are disposed in an intermediate plane of the above-mentioned substrate, and which are periodically arranged in a fixed direction; an aperture-equipped ground conductor, which is disposed on one of either the front surface or rear surface of the above-mentioned substrate, and in which a plurality of apertures are disposed; a ground conductor, which is disposed on the other of either the front surface or rear surface of the above-mention substrate; and permittivity controlling means for changing and controlling the permittivity of the above-mentioned variable permittivity material by applying a direct current voltage to the above-mentioned aperture-equipped ground conductor and the above-mentioned ground conductor. The above-mentioned conductor pattern is disposed by being galvanically isolated from another conductor pattern, the above-mentioned aperture-equipped ground conductor and the above-mentioned ground conductor. This antenna that uses a stripline-type transmission line is constituted so as to propagate an electromagnetic wave over a stripline-type transmission line comprising the above-mentioned substrate, the above-mentioned conductor pattern, the above-mentioned aperture-equipped ground conductor and the above-mentioned ground conductor, and to control the direction of the radiating electromagnetic wave with the above-mentioned permittivity controlling means.

Further, in the above-mentioned antenna that uses a stripline-type transmission line, when the phase constant of the electromagnetic wave to be propagated is represented as $\beta$, the array periodicity dimension of the above-mentioned conductor pattern is represented as a, and the circumference ratio is represented as $\pi$, the value $\beta a/\pi$ can fall within the range of $-1.0$ to 1.0.

Further, in the above-mentioned antenna that uses a stripline-type transmission line, when the phase constant of the electromagnetic wave to be propagated is represented as $\beta$, the array periodicity dimension of the above-mentioned conductor pattern is represented as a, and the circumference ratio is represented as $\pi$, the value $\beta a/\pi$ can fall within the range of −1.0 to 0.

Further, in the above-mentioned antenna that uses a stripline-type transmission line, it is preferable that the frequency of the electromagnetic wave to be propagated along the above-mentioned stripline-type transmission line be made constant, and that the direction of the radiating electromagnetic wave be controlled by changing the permittivity of the above-mentioned variable permittivity material with the above-mentioned permittivity controlling means.

Further, in the above-mentioned antenna that uses a stripline-type transmission line, it is also possible to control the direction of the radiating electromagnetic wave by changing the frequency of the electromagnetic wave to be propagated along the above-mentioned stripline-type transmission line, and by changing the permittivity of the above-mentioned variable permittivity material using the above-mentioned permittivity controlling means.

Further, in the above-mentioned antenna that uses a stripline-type transmission line, it is preferable that the surface areas of the above-mentioned apertures differ so as to adjust the amount of electromagnetic wave radiation from each of the apertures.

Further, in the above-mentioned antenna that uses a stripline-type transmission line, it is preferable that the surface areas of the above-mentioned apertures be set smaller as the aperture is positioned closer to an electromagnetic wave input terminal, and set larger as the aperture is positioned farther away from the electromagnetic wave input terminal so as to make the amount of electromagnetic wave radiation from each of the above-mentioned apertures substantially constant.

Further, in the above-mentioned antenna that uses a stripline-type transmission line, it is preferable that the above-mentioned aperture be slot shaped.

Further, in the above-mentioned antenna that uses a stripline-type transmission line, it is preferable that the surface areas of the above-mentioned apertures be made different by sequentially changing either the one or both of a length dimension and a width dimension of the above-mentioned aperture.

Being constituted as described hereinabove, the present invention exhibits the following effects.

In the stripline-type composite right/left-handed transmission line, changing the permittivity of the substrate can be done easily, and changing transmission characteristics, such as the dispersion characteristics of the transmission line, can be easily controlled by using a material of variable permittivity in either a part or the entire substrate and applying a direct current voltage between the ground conductors. Further, it is possible to prevent propagation wave radiation, and to carry out signal transmission and energy transmission without radiation-induced loss. Then, a composite right/left-handed transmission line that does not have a bandgap between the right-handed transmission band and the left-handed transmission band can be realized. In addition, using the ground conductors on the front surface and rear surface as electrodes for controlling the permittivity of the variable permittivity material does away with the need for surplus electrodes to apply the direct current voltage, thereby simplifying the structure and at the same time simplifying the design as well.

In the stripline-type left-handed transmission line, changing the permittivity of the substrate can be done easily, and changing transmission characteristics, such as the dispersion characteristics of the transmission line, can be easily controlled by using a material of variable permittivity in either a part or the entire substrate and applying a direct current voltage between the ground conductors. Further, it is possible to prevent propagation wave radiation, and carry out signal transmission and energy transmission without radiation-induced loss. In addition, using the ground conductors on the front surface and rear surface as electrodes for controlling the permittivity of the variable permittivity material does away with the need for surplus electrodes to apply the direct current voltage, thereby simplifying the structure and at the same simplifying the design as well.

In the antenna that uses a stripline-type transmission line, it is possible to change and control the permittivity of the substrate and to change and control the angle of radiation of a radiation beam across a wide range by applying a direct current voltage between the ground conductors. Further, since changing the angle of radiation can be controlled by making the frequency of the radiating electromagnetic waves constant, the control circuit for changing the angle of radiation can be simplified, and, in addition, the transmitting and receiving circuits can also be simplified. In addition, using the ground conductors on the front surface and rear surface as electrodes for controlling the permittivity of the variable permittivity material does away with the need for surplus electrodes to apply the direct current voltage, thereby simplifying the structure and at the same time simplifying the design as well.

In the antenna that uses a stripline-type transmission line, the respectively different surface areas of the plurality of apertures make it possible to arbitrarily adjust the amount of electromagnetic wave radiation from each of the apertures.

In the antenna that uses a stripline-type transmission line, making the surface areas of the apertures that are closer to the electromagnetic wave input terminal smaller, and the surfaces area of those that are farther away from the electromagnetic wave input terminal larger makes the amount of electromagnetic wave radiation from the respective apertures substantially constant, thereby enabling the improvement of the antenna's directional characteristics.

EXPLANATION OF REFERENCE NUMERALS

1 SUBSTRATE
2 GROUND CONDUCTOR
3 GROUND CONDUCTOR
4 CONDUCTOR PATTERN
5 APERTURE
6 IPUT PORT
7 PERMITTIVITY CONTROL CIRCUIT
11 SUBSTRATE

BEST MODE FOR CARRYING OUT THE INVENTION

Figure 5A:
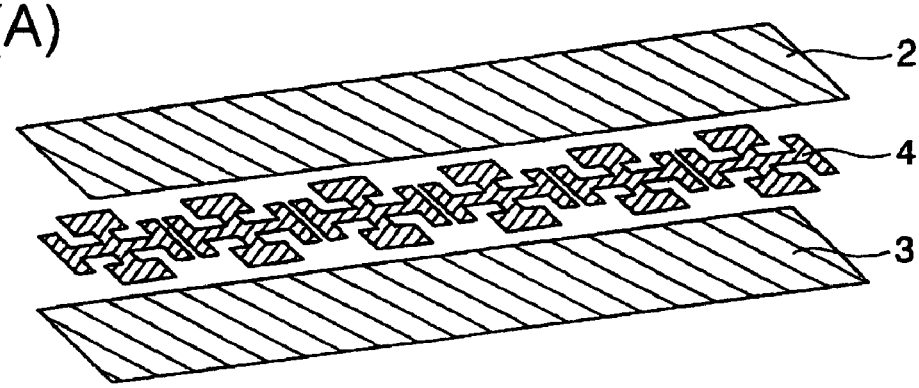
FIG. 5 is a diagram showing the constitution of a stripline-type composite right/left-handed transmission line of the present invention.
Figure 5B:
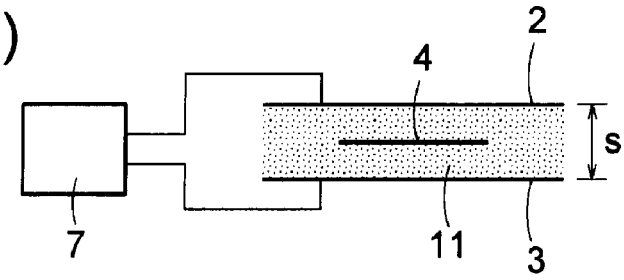

The embodiments of the present invention will be explained by referring to the figures. The stripline-type composite right/left-handed transmission line and the stripline-type left-handed transmission line of the present invention are transmission lines such as those shown in FIGS. 5(A) and (B). FIG. 5(A) is an oblique view displaying only the conductor that makes up the transmission line, and FIG. 5(B) is a cross-sectional view of the transmission line.

This transmission line is such that ground conductors 2 and 3 are disposed on the front surface and rear surface of the substrate 11 of thickness s comprising a material of variable permittivity, and a conductor pattern 4 is disposed as the transmission line in an intermediate plane of the substrate 1 (plane located at a thickness of s/2). This intermediate plane is a plane that parallels the front surface and rear surface of the substrate 11. The conductor pattern 4 periodically arrays in the direction of transmission unit cells comprising mutually insulated conductors. The ground conductors 2, 3 and the conductor pattern 4 respectively comprise conductors (typically, metals).

The ground conductors 2, 3, which cover the substrate 11 on both the front and rear surfaces, are galvanically isolated. Then, the ground conductors 2, 3 are connected by a sufficiently large capacitance (not shown in the figure). It is supposed that this capacitance enables the transmission of a propagation wave frequency signal at sufficiently low inductance. Then, changing the permittivity of the substrate 11, which is a material with variable permittivity, is controlled by applying a direct current voltage from a permittivity control circuit 7 between the ground conductors 2, 3. Changing the permittivity of the substrate 11 makes it possible to easily change and control transmission characteristics, such as the dispersion characteristics of the transmission line.

Furthermore, the substrate 11 shown here is formed entirely from a material with variable permittivity, but a portion of the substrate 11 can also be made of the variable permittivity material. Since even using a variable permittivity material just partially makes it possible to change the equivalent permittivity of the entire substrate 11 by changing the permittivity of the variable permittivity material, the functioning is the same as that explained hereinabove. As the variable permittivity material, a liquid crystal or the like for which the permittivity changes in accordance with an applied electrical field can be used. When this transmission line is used as a leaky-wave antenna, a plurality of slot-shaped apertures are disposed in the ground conductor of the one side (for example, the top surface side).

Figure 6:
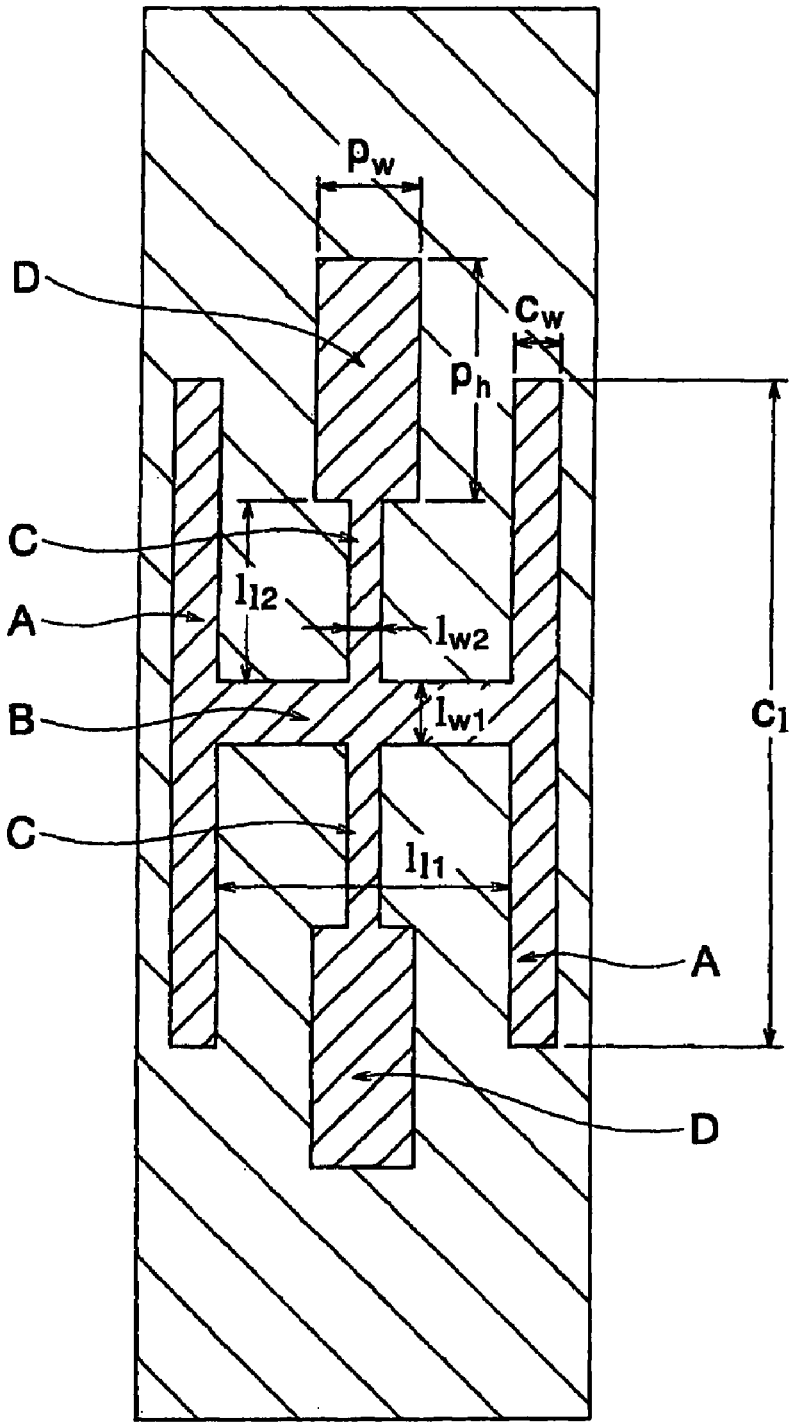
FIG. 6 is a diagram showing an enlarged view of the constitution of the unit cells of a conductor pattern 4.

FIG. 6 is an enlarged diagram showing the constitution of a unit cell of the conductor pattern 4. The respective unit cells are galvanically isolated. This conductor pattern is a constitution that does not use a via. That is, the respective unit cells of the conductor pattern 4 are galvanically isolated from the ground conductors 2, 3. The reason for using a via-free transmission line is because when the transmission line uses vias, the top and bottom ground conductors are galvanically connected, making it impossible to apply a permittivity-changing direct current voltage between the top and bottom ground conductors.

The unit cell of FIG. 6 has a conductive strip A that constitutes an electrode for inserting capacitance between adjacent unit cells; and a conductive strip B that connects the two parts of the conductive strip A on the right and left to one another. Further, a conductive strip C, which extends in the horizontal direction (the up-down direction in the figure) is connected to the central part of conductive strip B, and the tip of this conductive strip C is connected to a wide conductive strip D.

Conductive strip D imparts a large capacitance between the ground conductors 2, 3, achieving an effect that is the same as the tip of the conductive strip C being connected to the ground conductors 2, 3. The conductive strip C constitutes the inductance inserted between the ground conductors. The conductive strip D makes it possible to insert inductance between the ground conductors without the use of a via, and enables the transmission line to be made to function as a left-handed transmission line.

Figure 7A:
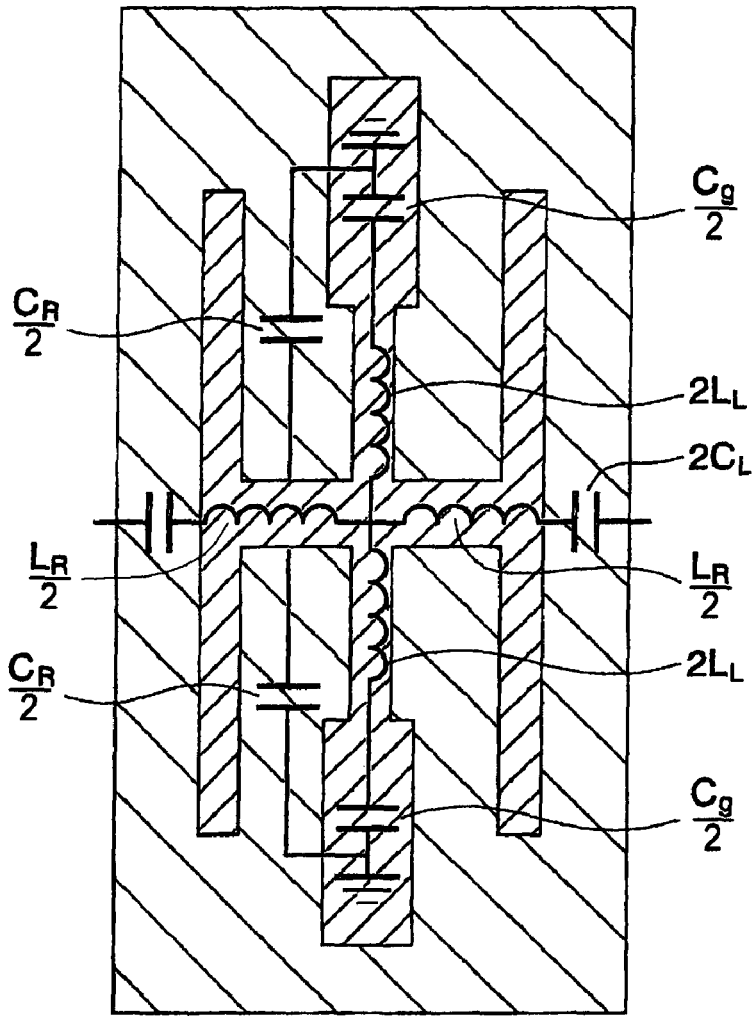
FIG. 7 is a diagram showing an equivalent circuit of the unit cell.
Figure 7B:
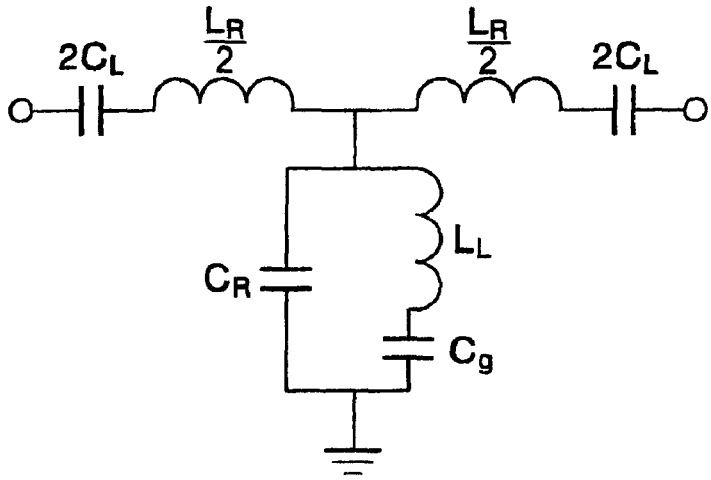

FIG. 7 is a diagram showing an equivalent circuit of the unit cell. FIG. 7(A) overlappingly displays the respective parts of the unit cell and the equivalent terminals. FIG. 7(B) shows the equivalent circuit that connects the respective equivalent terminals. In this equivalent circuit, the capacitance $C_L$ and inductance $L_L$ are equivalent terminal elements for functioning as a left-handed transmission line.

Figure 1:
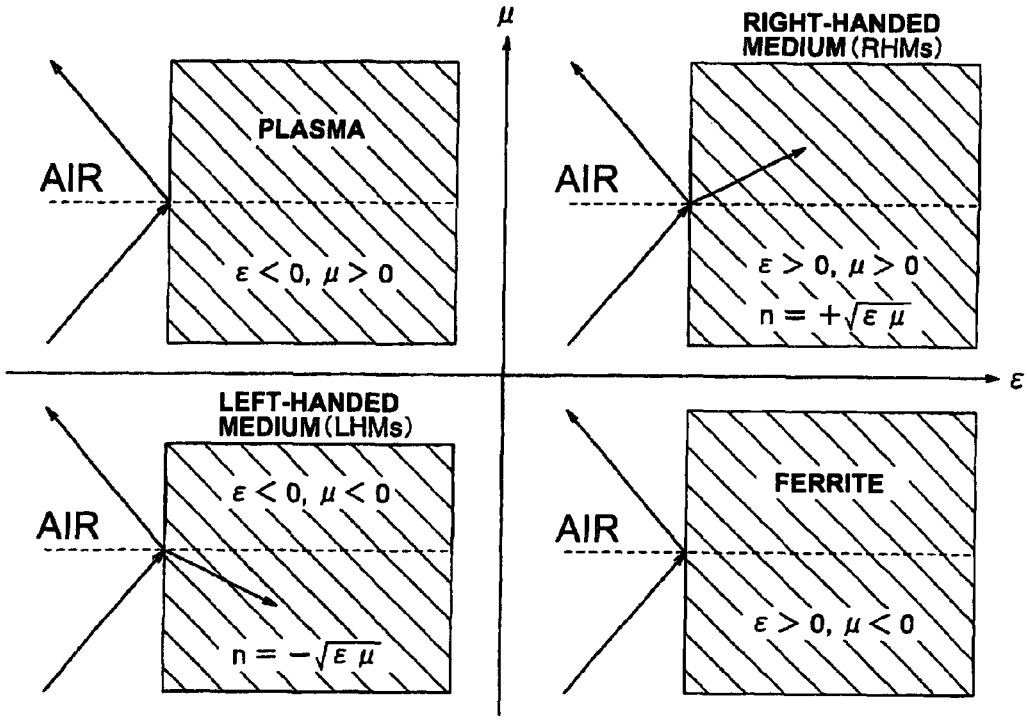
FIG. 1 is a diagram showing the relationships between the permittivity $\in$ and magnetic permeability $\mu$ of positive and negative regions and the medium.
Figure 2A:
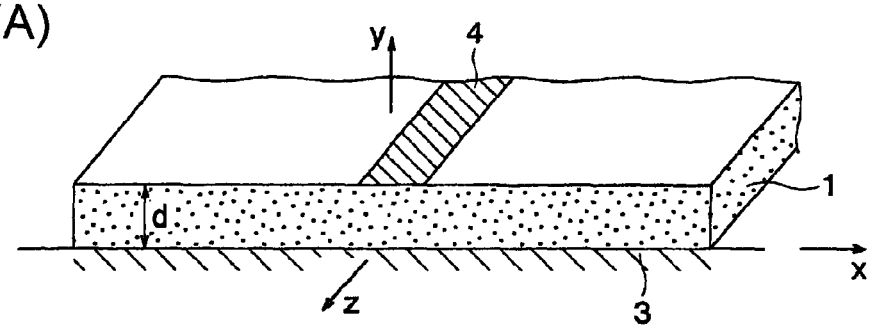
FIG. 2 is a diagram showing the constitution of a conventional microstrip line.
Figure 2B:
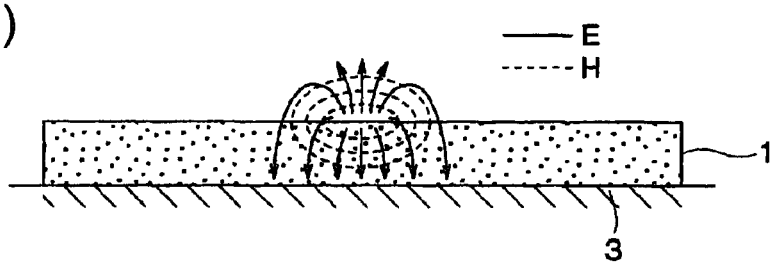
Figure 3A:
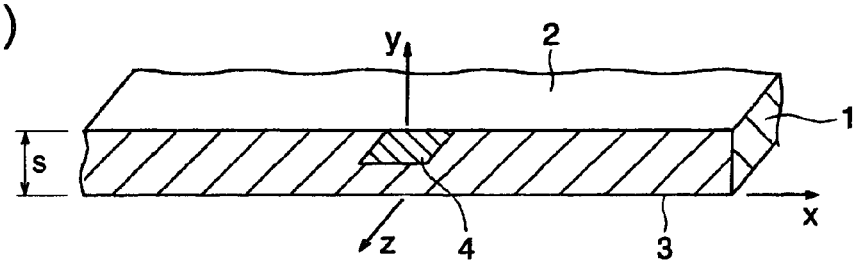
FIG. 3 is a diagram showing the constitution of a conventional stripline.
Figure 3B:
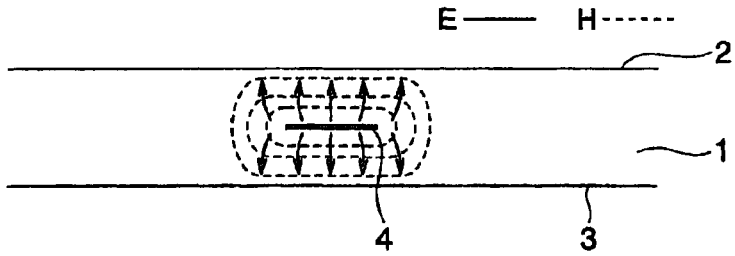
Figure 4A:
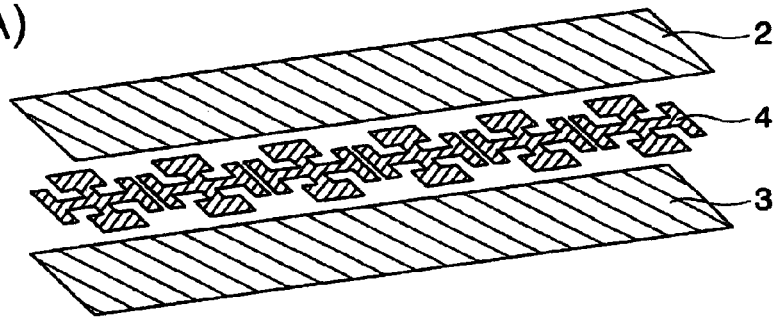
FIG. 4 is a diagram showing the constitution of a conventional stripline-type composite right/left-handed transmission line.
Figure 4B:
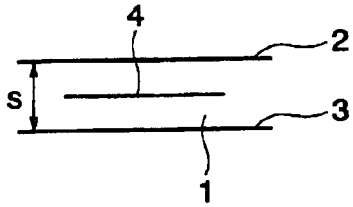

A transmission line that periodically arrays large numbers of unit cells like this in the direction of transmission has as a basic mode a stripline-type transmission mode in which the electrical field focuses on the conductor pattern 4 in the intermediate plane. That is, the electromagnetic field of a stripline transmission mode like that shown in FIG. 5 is the same as the electromagnetic field shown in FIG. 3(B), and radiation substantially does not occur since both the front and rear surfaces of the transmission line are covered by ground conductors 2, 3.

Next, the reason why a transmission line like that shown in FIG. 5 becomes either a composite right/left-handed transmission line or a left-handed transmission line will be explained. In the composite right/left-handed transmission line, skillfully designing the dispersion characteristics (the relationship between the phase constant β and the angular frequency ω) makes it possible to do away with the bandgap, and continuously change the phase constant β from a negative (left-handed) value to a positive (right-handed) value within a narrow frequency range. Furthermore, since the wave number of the propagation wave is normally referred to as the "phase constant" for a wave propagated in a fixed direction over a transmission line, this wave number will be so described in this specification as well.

Computing the dispersion characteristics of this periodic-structure line on the basis of the equivalent circuit of the unit cell shown in FIG. 7(B) results in the following Equation 1.

$$\beta=1/a\cdot\cos^{-1}[1+Z(\omega)Y(\omega)] \quad \text{Equation 1}$$

Here, β is the phase constant of the propagation wave, ω is the angular frequency of the propagation wave, and a is the array periodicity dimensions of the unit cell (array pitch). Further, Z(ω), Y(ω) are expressed by the following equations.

$$Z(\omega)=\tfrac{1}{2}[1/(j\omega C_L)+j\omega L_R]$$

$$Y(\omega)=1/[j\omega L_L+1/(j\omega C_g)]+j\omega C_R$$

Figure 8:
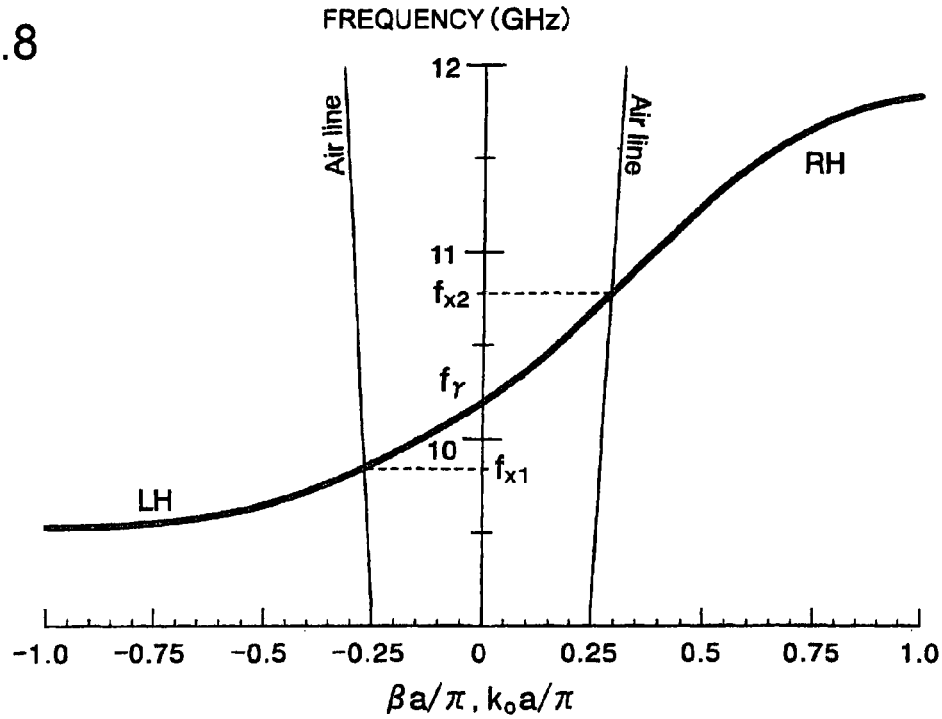
FIG. 8 is a graph showing the dispersion characteristics of a transmission line using an electromagnetic field simulation.

Further, the dispersion characteristics can also be found using an electromagnetic field simulation computation. FIG. 8 is a graph showing the dispersion characteristics of a transmission line obtained by providing a periodic boundary condition based on the structure of the unit cell of the present invention, and carrying out an electromagnetic field simulation computation using the three-dimensional finite element method. The horizontal axis represents values of phase constants β of propagation waves that have been normalized using the value (π/a), and the vertical axis represents the frequency f. Furthermore, a is the array periodicity dimension of the unit cell, and π is the circumference ratio. Further, the frequency f has the relationship ω=2πf with the angular frequency ω. The dispersion characteristics of the propagation wave constitute a smooth curved line like that shown in the figure, and become a continuous curved line even when β=0.

Furthermore, the dispersion characteristics of FIG. 8 have been computed such that the dimensions of the respective parts of the unit cell and the various numerical values of the transmission line are the following values. Here, the reference symbols representing the dimensions of the respective parts are as shown in FIG. 6.

$p_w$=1.5 mm, $p_h$=2.4 mm, $c_w$=0.5 mm, $c_1$=6.0 mm
$l_{l1}$=2.8 mm, $l_{w1}$=1.0 mm, $l_{l2}$=1.8 mm, $l_{w2}$=0.5 mm
Unit cell array periodicity: a=4.0 mm
Substrate thickness: s=1.016 mm
Substrate relative permittivity: $\in_r$=2.17

Meanwhile, the in-vacuum wave number $k_0$ has the relationship with the angular frequency ω and the speed of light $c_0$ expressed by the following Equation 2.

$$k_0=\pm\omega/c_0 \quad \text{Equation 2}$$

That is, the wave number $k_0$ is in a proportional relationship with the angular frequency ω, and is in a proportional relationship with the frequency f. The relationship between the wave number $k_0$ and the frequency f is the air line shown in FIG. 8. The horizontal axis of FIG. 8 constitutes values for which the wave number $k_0$ has been normalized for this air line using the value (π/a).

In FIG. 8, in the frequency range from 9.5 GHz to 10.2 GHz, which is $-1\leqq(\beta a/\pi)<0$, the phase velocity (ω/β) is negative, and the group velocity (∂ω/∂β), which is expressed by the slope of the dispersion curve, is positive. That is, the signs for the phase velocity and the group velocity are reversed, and this indicates that the propagation wave is a backward-wave. This is proof that this medium is one that exhibits left-handed characteristics.

Further, in the frequency range from 10.2 GHz to 11.8 GHz, which is $0<(\beta a/\pi)\leqq+1$, the phase velocity (ω/β) and the group velocity (∂ω/∂β) are both positive. In other words, the phase velocity and the group velocity are the same sign, and in this region, the medium exhibits right-handed characteristics. In FIG. 8, it is clear that the respective left-handed (LH) and right-handed (RH) transmission frequency bands continue in the frequency $f_\gamma$=10.2 GHz, and that there is no bandgap therebetween.

Thus, the stripline-type composite right/left-handed transmission line of the present invention can be realized by functioning in the range in which the value of the propagation wave phase constant β normalized by the value (π/a) falls between −1.0 to 1.0. In this composite right/left-handed transmission line, the transmission band can be made to continuously transition without a bandgap occurring between the left-handed transmission band and the right-handed transmission band. Further, since the substrate 11 is either partially or entirely composed of a material with variable permittivity, the transmission characteristics of the transmission line can be extensively changed and controlled by applying a direct current voltage to the ground conductors 2, 3 to change and control the permittivity of the substrate 11.

Further, the stripline-type left-handed transmission line of the present invention can be realized by functioning in the range in which the value of the propagation wave phase constant β normalized by the value (π/a) falls between −1.0 to 0. Further, since the substrate 11 is either partially or entirely composed of a material with variable permittivity, the transmission characteristics of the transmission line can be extensively changed and controlled by applying a direct current voltage to the ground conductors 2, 3 to change and control the permittivity of the substrate 11.

As described hereinabove, in the stripline-type composite right/left-handed transmission line and stripline-type left-handed transmission line of the present invention, radiation is not generated even in a region in which the wave number (phase constant) of the propagation wave is smaller than the in-vacuum wave number because both the front and rear surfaces of the substrate are covered by ground conductors. Therefore, in the transmission line of the present invention, signal transmission can be carried out efficiently without loss due to radiation.

Figure 9:
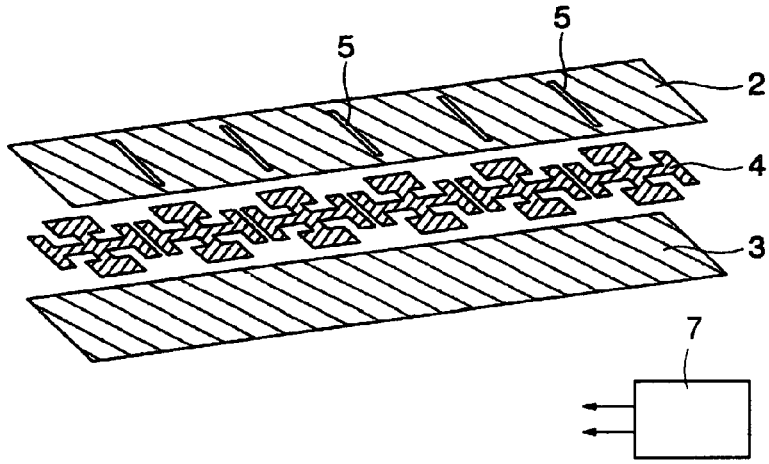
FIG. 9 is a diagram showing the constitution of an antenna that uses the transmission line of the present invention.

Next, an antenna that uses the transmission line of the present invention will be explained. In the antenna of this present invention, a plurality of apertures are periodically disposed in the ground conductor 2 of the one surface (the top surface side here) of the transmission line of the present invention as shown in FIG. 9. Further, the amount of radiation can be easily adjusted by sequentially changing the surface areas of the apertures 5. The shape of the aperture can be either a slot shape or a slit shape, or a shape that has the same function as these shapes.

Another constitution of the transmission line of this antenna is the same as that shown in FIG. 5. This constitution is such that an aperture-equipped ground conductor 2 and a ground conductor 3 are disposed on the front surface and the rear surface of a substrate 11 of thickness s comprising a material of variable permittivity, and a conductor pattern 4 is disposed as the transmission line in an intermediate plane (the plane located at a thickness of s/2) of the substrate 11. This intermediate plane is a plane that is parallel to the front surface and rear surface of the substrate 11. The conductor pattern 4 is such that unit cells comprising conductors that are isolated from one another are periodically arrayed in the direction of transmission. The aperture-equipped ground conductor 2, the ground conductor 3, and the conductor pattern 4 are respectively comprised of a conductor (typically a metal).

Then, the aperture-equipped ground conductor 2 and the ground conductor 3 are connected using sufficiently large capacitance (not shown in the figure). This capacitance enables a propagation wave frequency signal to be transmitted at sufficiently low impedance. The aperture-equipped ground conductor 2 and the ground conductor 3 are galvanically isolated, and a permittivity control circuit 7 is connected to these ground conductors. The permittivity control circuit 7 applies a direct current voltage between the aperture-equipped ground conductor 2 and the ground conductor 3 to change and control the permittivity of the substrate 11, which is a material with variable permittivity.

Figure 14A:
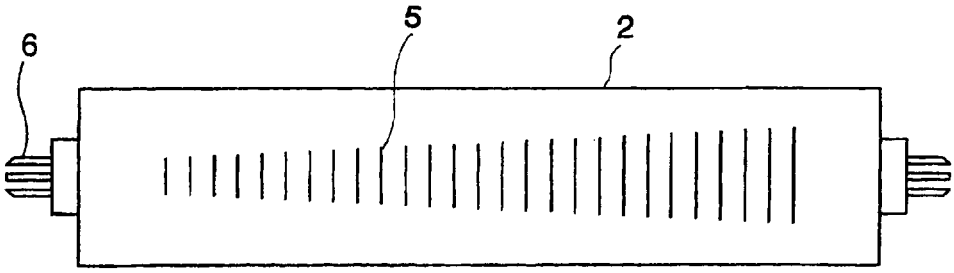
FIG. 14 is a diagram showing the constitution of a prototype antenna.
Figure 14B:
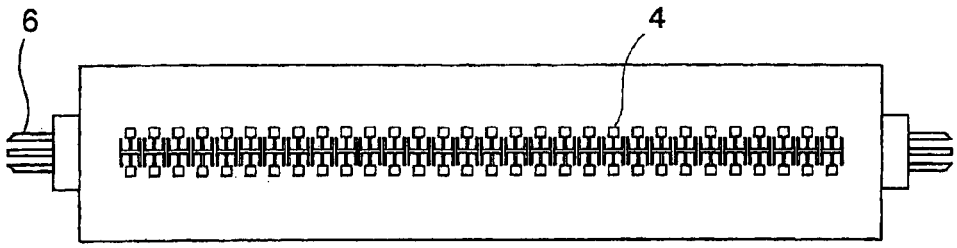

FIG. 14 is a diagram showing the constitution of an actual prototype of an antenna of the present invention. FIG. 14(A) shows the constitution of the aperture-equipped ground conductor 2, and FIG. 14(B) shows the constitution of the conductor pattern 4. An input port 6 is disposed at the end of this antenna for introducing a radiating electromagnetic wave. The apertures 5 formed in the aperture-equipped ground conductor 2 are slot shaped, and are rectangular shapes in which the length (the dimension in the up-down direction in FIG. 14) is sufficiently greater than the width (the dimension in the left-right direction in FIG. 14). Then, the closer an apertures 5 is to the input port 6, the shorter its length, and by contrast, the farther an aperture 5 is from the input port 6, the longer its length.

By sequentially changing the lengths of the apertures 5 like this, the amount of radiation from the respective apertures 5 can be made substantially constant, and, in addition, the side lobe level can be made substantially symmetrical. Furthermore, the lengths of the apertures 5 are changed here, but, briefly stated, the amount of radiation can be adjusted by changing the surface areas of the apertures 5. The surface area of an aperture 5 can be changed by changing either one or both of the length and width of the aperture 5. That is, only the length of the aperture 5 can be changed, or only the width of the aperture 5 can be changed, or both the length and width of the aperture 5 can be changed.

Figure 15:
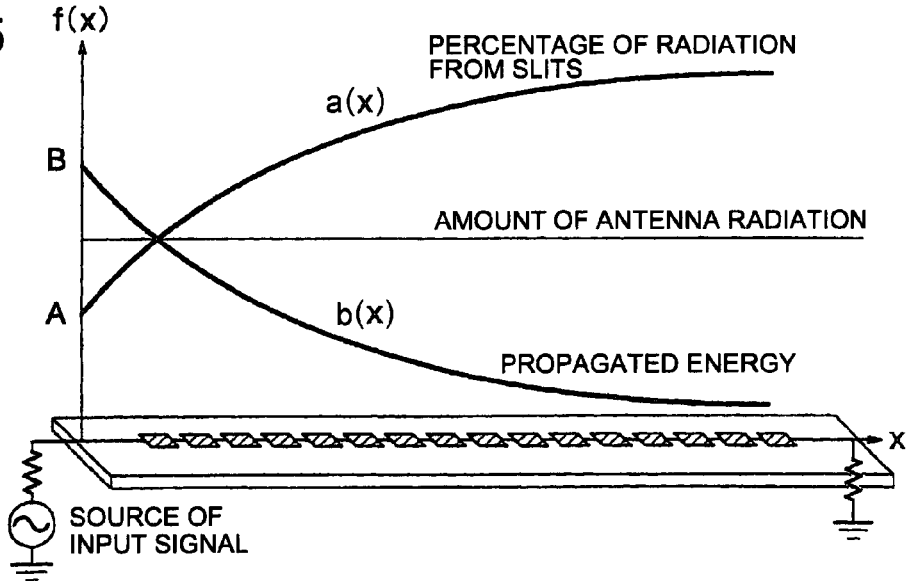
FIG. 15 is a diagram showing the energy and amount of radiation propagated over the transmission line.

As shown in FIG. 15, the energy inputted from the input port 6 and propagated along the transmission line is greater closer to the input port 6, and becomes smaller farther away from the input port 6. To make the amount of radiation from the respective apertures of the antenna constant, the percentage of radiation at the respective apertures can be set so as to be smaller closer to the input port 6, and to become larger farther away from the input port 6. That is, the surface areas of the respective apertures 5 can be made smaller the closer the aperture 5 is to the input port 6, and larger the farther away the aperture 5 is from the input port 6.

Further, depending on the antenna application, it may be necessary to discretionarily control the amount of energy radiation at each part of the antenna rather than make the amount of energy radiation from the respective apertures 5 constant. In this case, appropriately setting the surface areas of the antenna's apertures makes it possible to discretionarily control the amount of energy radiation from the aperture at each part of the antenna to realize the desired antenna characteristics.

The difference between an antenna comprising a stripline-type left-handed transmission line and a stripline-type composite right/left-handed transmission line will be explained by referring to the dispersion characteristics of FIG. 8. When the dispersion curve is plotted such that the slope of the dispersion curve is always positive (when the direction of energy propagation of the propagation wave is set to the positive direction of a coordinate system), the differences are as follows.

(A) Left-handed transmission line antenna if used in a frequency range in which the phase constant $\beta$ is negative (B) Right-handed transmission line antenna if used in a frequency range in which the phase constant $\beta$ is positive (C) Composite right/left-handed transmission line antenna if used in a region in which the phase constant $\beta$ straddles positive and negative Next, the changing and controlling of the radiation angle by changing the dispersion characteristics of the transmission line to be used as an antenna of the present invention will be explained. Changing the permittivity of the substrate 11 comprising a material with variable permittivity makes it possible for an antenna that uses the transmission line of the present invention to carry out a wide-angle beam scan.

As shown in FIG. 9, since a plurality of apertures 5 are formed in the aperture-equipped ground conductor 2 of the transmission line, electromagnetic beams are radiated from these apertures 5. The radiation angle of the electromagnetic beam is generally expressed as the angle from the broadside direction (frontal direction of radiation). In the antenna that uses the transmission line of the present invention, the broadside direction is the direction that is orthogonal to the transmission direction of the transmission line. The radiation angle $\delta$ of the beam is determined from the phase constant $\beta$ of the propagation wave and the in-vacuum wave number $k_0$ using Equation 3 below. Equation 3 can also be constructed as Equation 4.

$$\pi/2-\theta=\cos^{-1}(\beta/k_0) \quad \text{Equation 3}$$

$$\theta=\sin^{-1}(\beta/k_0) \quad \text{Equation 4}$$

Figure 10:
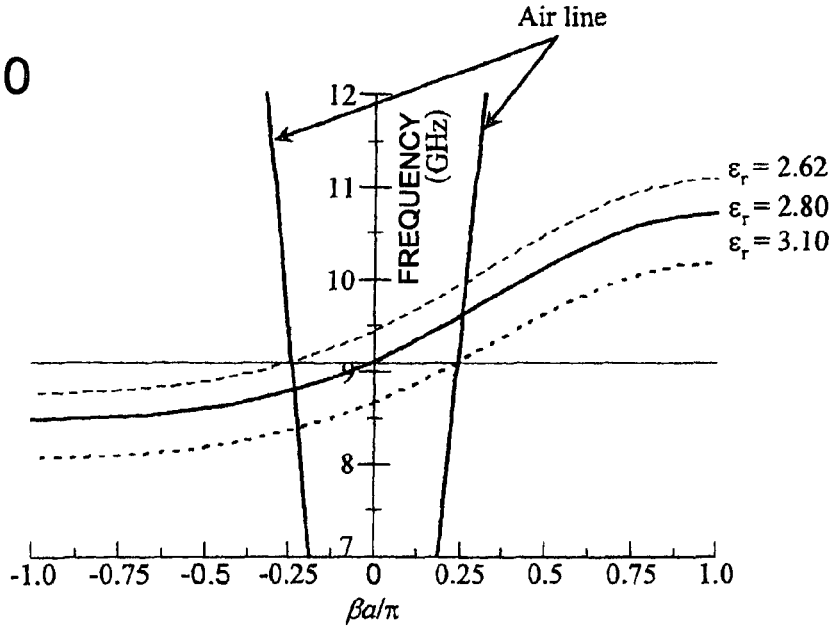
FIG. 10 is a graph showing the dispersion characteristics of the transmission line when the permittivity has been changed.

FIG. 10 determines the dispersion characteristics of the transmission line of the present invention using the same electromagnetic field simulation computation as that of FIG. 8. However, the dispersion characteristics of FIG. 10 are determined by changing the relative permittivity $\in_r$ of the substrate 11 three-fold to 2.62, 2.80 and 3.10. The solid line indicates that a dispersion curve of $\in_r$=2.80 constitutes the standard. The dispersion curve of $\in_r$=2.62 is the curve indicated by the dotted line shown above the standard curve. The dispersion curve of $\in_r$=3.10 is the curve indicated by the dotted line shown below the standard curve. The relationship between the in-vacuum wave number $k_0$ and the frequency f is indicated by the air line the same as in FIG. 8.

For example, a case in which the frequency f is 9.1 GHz will be explained. This frequency f=9.1 GHz is indicated by a horizontal straight line displayed as a thin solid line in FIG. 10. When the substrate 11 relative permittivity $\in_r$=2.80, $\beta/k_0$ is 0, and the radiation angle $\theta$ becomes 0 using Equation 4. That is, the electromagnetic wave beam radiates in the radiation frontal direction. When $\in_r$=2.62, $\beta/k_0$ is −1 and the radiation angle $\theta$ becomes $-\pi/2$. Further, when $\in_r$=3.10, $\beta/k_0$ is 1 and the radiation angle $\theta$ becomes $\pi/2$. That is, it is clear that when the relative permittivity $\in_r$ changes from 2.62 to 3.10, the radiation angle $\theta$ changes within a range of 180 degrees, from a backward transmission direction of −90 degrees to a forward transmission direction of 90 degrees.

Figure 11:
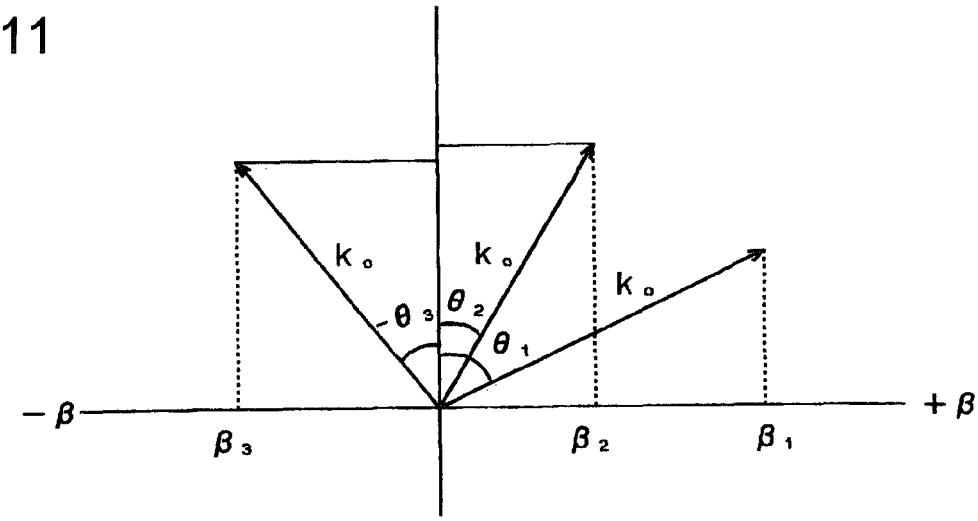
FIG. 11 is a vector diagram showing the relationship between the phase constant β and the angle of radiation θ.

FIG. 11 is a vector diagram showing the relationships between the phase constant $\beta$, the in-vacuum wave number $k_0$ and the radiation angle $\theta$. This vector diagram also reveals the radiation angle $\theta$ when the phase constant $\beta$ is an arbitrary value between $-k_0$ and $k_0$. When the in-vacuum wave number $k_0$ is made constant and the phase constant $\beta$ changes from $\beta_1$ to $\beta_2$ to $\beta_3$, the beam radiation angle $\theta$, which is the angle from the broadside (radiation frontal direction), changes from $\theta_1$ to $\theta_2$ to $\theta_3$. The radiation angle $\theta$ can similarly be determined for an arbitrary value of the phase constant $\beta$ between $-k_0$ and $k_0$.

Figure 13:
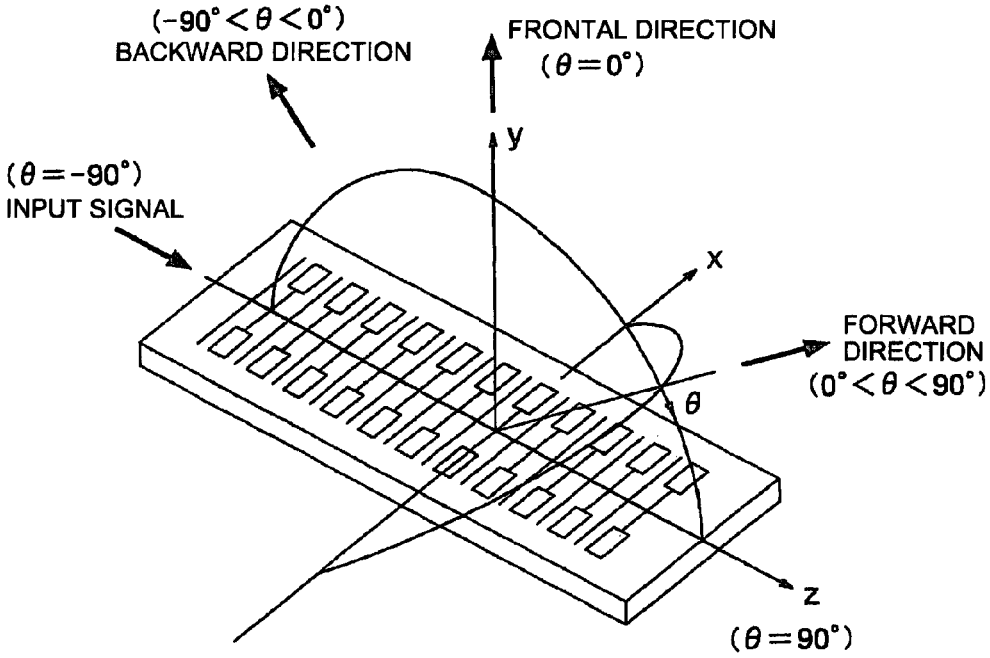
FIG. 13 is a schematic diagram showing the operation of the antenna of the present invention.

FIG. 13 is a schematic diagram showing the operation of the antenna of the present invention. The electromagnetic wave to be radiated is inputted from the input port 6 (refer to FIG. 14), and is propagated along a transmission line that constitutes the antenna as shown in FIG. 13. Changing the permittivity of the substrate 11 of the transmission line makes it possible to extensively change the beam radiation angle θ from the range of $-90° \leqq \theta < 0°$, which is backward relative to the direction of propagation, to $\theta = 0°$, which is orthogonal to the direction of propagation, and to the range $0° < \theta \leqq 90°$, which is forward relative to the direction of propagation.

In the antenna of the present invention, since the dispersion characteristics of the transmission line change greatly in accordance with changing the permittivity, in principle, it is possible to significantly change the radiation angle θ by changing the permittivity slightly. For example, when a liquid crystal is used as the variable permittivity material and the relative permittivity $\in_r$ is changed within the range from 2.62 to 3.10, a wide-angle beam scan spanning $-90° \leqq \theta \leqq 90°$ also becomes possible. Further, since the frequency of the radiating electromagnetic wave can be made constant and the radiation angle θ can be changed and controlled, it is possible to simplify the control circuit for a beam scan, and, in addition, to simplify the transmitting and receiving circuits as well.

Figure 12:
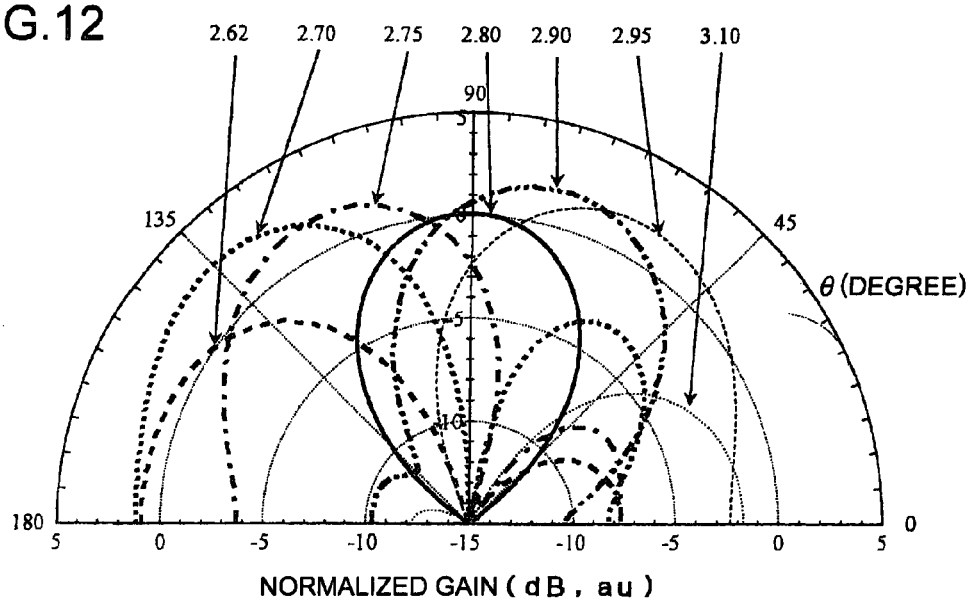
FIG. 12 is a graph showing the radiation directivity of the antenna of the present invention.

FIG. 12 is a graph showing the radiation directivity characteristics of the antenna of the present invention. This graph shows in polar form the radiation pattern computation results obtained by analyzing the electromagnetic field for the antenna of the present invention on the basis of the moment technique. It is supposed that there are nine slot-shaped apertures, and that the relative permittivity $\in_r$ of the variable permittivity material is changed from 2.62 to 3.10 by changing the direct current voltage applied to the ground conductors 2, 3. Further, the structure of the transmission line is adjusted such that the bandgap completely disappears.

The graph of FIG. 12 shows radiation patterns for the respective relative permittivity $\in_r$ values of 2.62, 2.70, 2.75, 2.80, 2.90, 2.95 and 3.10. However, the intensity of each radiation pattern is expressed as normalized gain for which the central intensity of the broadside is 0 dB. In this graph, the radial axis represents normalized gain, and the angular axis represents the radiation angle.

In the stripline-type composite right/left-handed transmission line, the bandgap can be done away with by skillfully designing the dispersion characteristics (the relationship between the phase constant β and the angular frequency ω), and the phase constant β can be rapidly changed from a negative (left-handed) to a positive (right-handed) value within a narrow frequency range. It is thus possible to change and control the frequency of the radiating electromagnetic wave, and to widely oscillate the beam radiation angle θ in both the forward and backward directions. Referring to FIG. 8, it is clear that changing the frequency f in the range of $f_{x1}$ to $f_{x2}$ makes it possible to change the beam radiation angle θ from backward to forward.

In the antenna of the present invention, since it is possible to make the frequency of the radiating electromagnetic wave constant and to change and control the radiation angle θ, there is no need to change the frequency of the radiating electromagnetic wave. However, it is also possible to change the permittivity of the substrate and to change the frequency of the radiating electromagnetic wave in combination with one another. In particular, when the range of permittivity change of the variable permittivity material is small, jointly changing the permittivity and frequency of the radiating electromagnetic wave makes it possible to expand the range for changing the radiation angle θ. In this case, too, jointly changing both frequency and permittivity is more advantageous than controlling the radiation angle by only changing the frequency in that the range of change of the radiating electromagnetic wave frequency can be kept small.

Conversely, for a conventional leaky-wave antenna, there is a scheme that uses a waveguide, a scheme that adds a periodic disturbance unit and uses spatial harmonic components, and a scheme that uses a higher-order propagation mode. All of these schemes change the frequency of the radiating electromagnetic wave and change the radiation angle θ of the beam. Thus, in a practical variable frequency range (for example, a range of approximately 10% of the specific band frequency), $\beta/k_0$ cannot be significantly changed since the phase constant β cannot be changed greatly relative to a change in the in-vacuum wave number $k_0$.

For this reason, a change to the radiation angle θ becomes extremely limited. Furthermore, it is not possible to continuously change the phase constant β from positive to negative by changing the frequency, with the result that the direction of the beam radiation becomes limited to either only forward or only backward. By contrast, in the antenna that uses the transmission line of the present invention, the range over which it is possible to change the radiation angle θ of the radiated beam is significantly wider than in conventional such antennas.

Further, making the surface areas of the plurality of periodic apertures 5 the same will result in an increase in radiated energy from the apertures 5 closer to the input port 6, and a decrease in radiated energy from the apertures 5 farther away from the input port 6. Accordingly, as shown in FIG. 14, in the antenna of the present invention, the surface areas of the plurality of apertures 5 are set so as to sequentially change from closer to farther away from the input port 6, thereby making it possible to easily adjust the amount of electromagnetic wave radiation by changing the surfaces areas of the apertures 5.

Further, rather than making the amount of energy radiation from the respective apertures 5 constant, it may be necessary to discretionarily control the amount of energy radiation at each part in accordance with the antenna application. In this case, appropriately setting the surface areas of the apertures of the antenna makes it possible to discretionarily control the amount of energy radiation from the apertures at each part of the antenna to realize the desired antenna characteristics. For example, when the percentage of radiation on the antenna surface is properly set, it is also possible to realize Chebyshev-type radiation directivity characteristics that keep the value of the side lobe uniformly low.

As described hereinabove, in the stripline-type composite right/left-handed transmission line and stripline-type left-handed transmission line of the present invention, transmission characteristics, such as the dispersion characteristics of the transmission line, can be easily changed and controlled by changing the permittivity of the substrate 11, which is a material with variable permittivity. Further, changing permittivity can be easily carried out by applying a direct current voltage between the ground conductors 2, 3.

Then, in an antenna that uses the stripline-type transmission line of the present invention, it is possible to extensively change the radiation angle of a radiated beam. Further, since the frequency of the radiating electromagnetic wave can be made constant and the radiation angle can be changed and controlled, the control circuit for changing the radiation angle can be simplified, and, in addition, the transmitting and receiving circuits can also be simplified.

INDUSTRIAL APPLICABILITY

The stripline-type composite right/left-handed transmission line and stripline-type left-handed transmission line of the present invention can be applied to a microwave transmission line, coupler, resonator, and divider or the like. Further, an antenna that uses the stripline-type transmission line of the present invention can make the frequency constant and control the direction of the radiated beam, and can be used as an antenna for an automobile or for obstacle detection in an ambulatory robot.

The invention claimed is:

1. A stripline-type composite right/left-handed transmission line comprising:

a plate-shaped substrate comprising a dielectric medium, which is either partially or wholly composed of a material with variable permittivity;

a plurality of conductor patterns, which are disposed in an intermediate plane of said substrate, and which are periodically arranged in a fixed direction;

ground conductors, which are disposed on the front surface and rear surface of said substrate, and which are disposed by being galvanically isolated from one another; and permittivity controlling means for changing and controlling the permittivity of said variable permittivity material by applying a direct current voltage between said ground conductors, wherein a conductor pattern of said plurality of conductor patterns is disposed by being galvanically isolated from another conductor pattern of said plurality of conductor patterns and said round conductors, and said stripline-type composite right/left-handed transmission line is capable of propagating an electromagnetic wave in a right-handed region and a left-handed region.

2. The stripline-type composite right/left-handed transmission line according to claim 1, wherein when a phase constant of the electromagnetic wave to be propagated is represented as $\beta$, an array periodicity dimension of said conductor pattern is represented as a, and the circumference ratio is represented as $\pi$, the value $\beta a/\pi$ falls within the range of $-1.0$ to 1.0.

3. A stripline-type left-handed transmission line comprising:

a plate-shaped substrate comprising a dielectric medium, which is either partially or wholly composed of a material with variable permittivity;

a plurality of conductor patterns, which are disposed in an intermediate plane of said substrate, and which are periodically arranged in a fixed direction;

ground conductors, which are disposed on the front surface and rear surface of said substrate, and which are disposed by being galvanically isolated from one another; and permittivity controlling means for changing and controlling the permittivity of said variable permittivity material by applying a direct current voltage between said ground conductors, wherein a conductor pattern of said plurality of conductor patterns is disposed by being galvanically isolated from another conductor pattern of said plurality of conductor patterns and said round conductors, and said stripline-type left-handed transmission line is capable of propagating an electromagnetic wave in a left-handed region.

4. The stripline-type left-handed transmission line according to claim 3, wherein when a phase constant of the electromagnetic wave to be propagated is represented as $\beta$, and array periodicity dimension of said conductor pattern is represented as a, and the circumference ratio is represented as $\pi$, the value $\beta a/\pi$ falls within the range of $-1.0$ to 0.

5. An antenna that uses a stripline-type transmission line, comprising:

a plate-shaped substrate comprising a dielectric medium, which is either partially or wholly composed of a material with variable permittivity;

a plurality of conductor patterns, which are disposed in an intermediate plane of said substrate, and which are periodically arranged in a fixed direction;

an aperture-equipped ground conductor, which is disposed on one of either the front surface or rear surface of said substrate, and in which a plurality of apertures are disposed;

a ground conductor, which is disposed on the other of either the front surface or rear surface of said substrate and which is disposed by being galvanically isolated from said aperture-equipped ground conductor; and permittivity controlling means for changing and controlling the permittivity of said variable permittivity material by applying a direct current voltage to said aperture-equipped ground conductor and said ground conductor, wherein a conductor pattern of said plurality of conductor patterns is disposed by being galvanically isolated from another conductor pattern of said plurality of conductor patterns, said aperture-equipped ground conductor and said ground conductor, and an electromagnetic wave is propagated over the stripline-type transmission line comprising said substrate, said conductor pattern, said aperture-equipped ground conductor and said ground conductor, and the direction of the radiating electromagnetic wave is controlled by said permittivity controlling means.

6. The antenna that uses a stripline-type transmission line according to claim 5, wherein when a phase constant of the electromagnetic wave to be propagated is represented as $\beta$, an array periodicity dimension of said conductor pattern is represented as a, and the circumference ratio is represented as $\pi$, the value $\beta a/\pi$ falls within the range of $-1.0$ to 1.0.

7. The antenna that uses a stripline-type transmission line according to claim 5, wherein when a phase constant of the electromagnetic wave to be propagated is represented as $\beta$, an array periodicity dimension of said conductor pattern is represented as a, and the circumference ratio is represented as $\pi$, the value $\beta a/\pi$ falls within the range of $-1.0$ to 0.

8. The antenna that uses a stripline-type transmission line according to claim 5, wherein the frequency of an electromagnetic wave to be propagated along said stripline-type transmission line is made constant, and said permittivity controlling means controls the direction of the radiating electromagnetic wave by changing the permittivity of said variable permittivity material.

9. The antenna that uses a stripline-type transmission line according to claim 5, wherein the frequency of an electromagnetic wave to be propagated along said stripline-type transmission line is changed, and the permittivity of said variable permittivity material is changed by said permittivity controlling means, then the direction of the radiating electromagnetic wave is controlled.

10. The antenna that uses a stripline-type transmission line according to any one of claims 5 through 9, wherein the respective surface areas of said apertures are made different so as to adjust the amount of electromagnetic wave radiation from each of said apertures.

11. The antenna that uses a stripline-type transmission line according to claim 10, wherein the surface area of said aperture is set smaller as said aperture is positioned closer to an electromagnetic wave input terminal, and set larger as said aperture is positioned farther away from the electromagnetic wave input terminal so as to make the amount of electromagnetic wave radiation from each of said apertures substantially constant.

12. The antenna that uses a stripline-type transmission line according to claim 11, wherein said aperture is slot shaped.

13. The antenna that uses a stripline-type transmission line according to claim 12, wherein the respective surface areas of said apertures are made different by sequentially changing either the one or both of a length dimension and a width dimension of said aperture.

* * * * *